US005775951A

United States Patent [19]

Gargiulo

[11] Patent Number: 5,775,951

[45] Date of Patent: *Jul. 7, 1998

[54] HI-JACK HINGED CONNECTION ADAPTER FOR INPUT/OUTPUT CARDS

[75] Inventor: Richard R. Gargiulo, Folsom, Calif.

[73] Assignee: Intel Corporation, Santa Clara, Calif.

[ * ] Notice: The term of this patent shall not extend beyond the expiration date of Pat. No. 5,637,018.

[21] Appl. No.: 724,625

[22] Filed: Sep. 30, 1996

Related U.S. Application Data

[63] Continuation-in-part of Ser. No. 333,139, Nov. 1, 1994.

[51] Int. Cl.[6] ..... H01R 25/00

[52] U.S. Cl. ..... 439/640; 439/31; 439/131; 439/946

[58] Field of Search ..... 439/640, 946

[56] References Cited

U.S. PATENT DOCUMENTS 5,637,018 6/1997 Gargiulo ..... 439/640

*Primary Examiner*—P. Austin Bradley

*Assistant Examiner*—Brian J. Biggi

*Attorney, Agent, or Firm*—Blakely, Sokoloff, Taylor & Zafman

[57] ABSTRACT

A hinged adapter provides for the connection of input/output (I/O) cards to a communication connector, such as an RJ-type connector for example, for data processing systems. The hinged adapter has a first connector configured to mate with a connector at the end of an I/O card inserted in a receptacle of a data processing system. The hinged adapter also has a second connector configured to mate with the communication connector. The second connector is mounted to the first connector with a hinge. The second connector may be positioned in an operational position for mating with the communication connector. When not in use, the second connector may be rotated or folded about the hinge relative to the first connector into a stored position. The data processing system, I/O card, and hinged adapter may then be transported as an integral unit.

28 Claims, 6 Drawing Sheets

HI-JACK HINGED CONNECTION ADAPTER FOR INPUT/OUTPUT CARDS

RELATED APPLICATION

This is a continuation of application Ser. No. 08/333,139, filed Dec. 1, 1994.

This patent application is related to U.S. patent application Ser. No. 08/275,599, entitled I/O CONNECTOR FOR ADD IN PRINTED CIRCUIT CARDS FOR COMPUTER SYSTEMS, by Duncan D. MacGregor, Neal E. Broadbent, Chengwu Chen, and Richard Gargiulo, filed Jul. 15, 1994, and assigned to the assignee of the present patent application.

BACKGROUND OF THE INVENTION

1. Field of the Invention:

The present invention relates generally to the field of input/output cards for data processing systems. More particularly, the present invention relates to the field of connectors for input/output cards for data processing systems.

2. Description of the Related Art:

Data processing systems have been configured for use with peripheral or input/output (I/O) cards that provide increased functionality for the data processing system. As one example, I/O cards may be used to provide for increased memory capacity for the data processing system. I/O cards may also be used to provide for communication capabilities for the data processing system with external data processing systems over networks. I/O cards provide convenience for users in allowing them to install, as desired, additional capabilities for the data processing system.

I/O cards are typically portable cards that may be inserted into and detached from a socket housed within the data processing system. The data processing system and I/O cards may be configured such that different types of I/O cards, such as a modem card or a memory card for example, may be interchangeably inserted in, used, and removed from the same socket. The data processing system may be configured to house and therefore protect an I/O card once inserted into a socket. I/O cards may be conveniently carried along with portable data processing systems, such as notebook or laptop computer systems, either separately or while housed within the system.

The Personal Computer Memory Card International Association (PCMCIA) has devised standards for I/O cards to provide compatibility between various data processing systems and various I/O cards. The PCMCIA standards specify, for example, dimensions for the I/O card. The PCMCIA standards also specify a 68-pin connector at one end of a PCMCIA card for insertion into a compatible socket in the data processing system. The 68-pin connector provides for a communication interface between the data processing system and the PCMCIA card.

To provide communication capabilities for a data processing system, PCMCIA cards are also configured with another connector for communication over an external network with other data processing systems, for example. This other connector is typically located at the end of the PCMCIA card opposite the 68-pin connector and is typically accessible to a user when the PCMCIA card is already inserted into the data processing system.

Using this other connector, PCMCIA cards may be connected to telephone networks or local area networks (LANs), for example. Although an RJ-11 connector is typically used for connection to telephone networks and an RJ-45 connector is typically used for connection to local area networks, these RJ-type connectors are relatively large compared to the thickness of PCMCIA cards.

An adapter cable may be used to connect a PCMCIA card using such RJ-type connectors. An adapter cable includes a cable with a connector at one end configured for attachment to the PCMCIA card and a connector at the other end configured to mate with an RJ-type connector. Adapter cables are inconvenient to users of portable computer systems because the adapter cable must be carried separately with the portable computer system and may be forgotten. In transporting portable computer systems, adapter cables are also relatively bulky as compared to PCMCIA cards, for example, that may be easily carried in a pocket or while inserted in the portable computer system.

To obviate the need for an adapter cable, a PCMCIA card may be designed with a retractable connector. U.S. Pat. No. 5,183,404, entitled SYSTEMS FOR CONNECTION OF PHYSICAL/ELECTRICAL MEDIA CONNECTORS TO COMPUTER COMMUNICATIONS CARDS, disclosed a retractable connector for a PCMCIA card. The retractable connector may be engaged to extend from the body of the PCMCIA card while the PCMCIA card is inserted in the data processing system. A user may then plug a male RJ-11 connector directly into the retractable connector for connection to an external network. When not in use, the retractable connector may be retracted inside the PCMCIA card.

Because the retractable connector uses a flexible locking mechanism of RJ-11 connectors, the retractable connector remains connected to the RJ-11 connector until the RJ-11 connector is manually detached from the retractable connector. When the retractable connector is subjected to a firm tug on the network line connected to the retractable connector, such as when a user trips over the network line for example, the RJ-11 connector as well as the retractable connector are susceptible to breakage. The data processing system may also be pulled off a table onto the floor as a result of such a firm tug and consequently damaged.

The retractable connector also requires a user-movable retraction mechanism, increasing the complexity of design and manufacture of the PCMCIA card. Furthermore, the retractable connector consumes space inside the PCMCIA card and thus limits the amount of space available for circuitry in implementing the functionality provided by the PCMCIA card.

SUMMARY AND OBJECTS OF THE INVENTION

One object of the present invention is to provide for an input/output (I/O) card connection adapter that may be carried with a portable data processing system with relative convenience.

Another object is to provide for an I/O card connection adapter that does not consume space inside the I/O card.

A communications adapter for connecting a communication connector and an input/output (I/O) card inserted in a receptacle defined by a body of a data processing system is described. The I/O card has an I/O card connector at an end exposed by the receptacle when the I/O card is inserted in the receptacle of the body of the data processing system. The communications adapter includes a first member configured to mate with the I/O card connector of the I/O card and a second member configured to mate with the communication connector. The second member is configured with the first member such that the second member may be positioned in an operational position for mating with the communication connector when the first member is mated with the I/O card connector of the I/O card in the receptacle of the body of the data processing system. The second member is configured with the first member such that the second member may be positioned in a stored position different from the operational position when the first member is mated with the I/O card connector of the I/O card in the receptacle of the body of the data processing system.

An input/output (I/O) card combination for connecting a data processing system and a communication connector is also described. The data processing system has a body defining a receptacle. The I/O card combination includes an I/O card for insertion into the receptacle of the body of the data processing system. The I/O card is configured for connection to the data processing system and has an I/O card connector at an end exposed by the receptacle when the I/O card is inserted in the receptacle of the body of the data processing system. The I/O card combination further includes a first member configured to mate with the I/O card connector of the I/O card and a second member configured to mate with the communication connector. The second member is configured with the first member such that the second member may be positioned in an operational position for mating with the communication connector when the first member is mated with the I/O card connector of the I/O card in the receptacle of the body of the data processing system. The second member is configured with the first member such that the second member may be positioned in a stored position different from the operational position when the first member is mated with the I/O card connector of the I/O card in the receptacle of the body of the data processing system.

Other objects, features, and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

The following detailed description sets forth an embodiment or embodiments in accordance with the present invention for hi-jack hinged connection adapter for input/output cards. In the following description, details are set forth such as specific types of communication plugs, input/output applications, etc., in order to provide a thorough understanding of the present invention. It will be evident, however, that the present invention may be practiced without these details. In other instances, well-known devices, structures, etc., have not been described in particular detail so as not to obscure the present invention.

Figure 1:
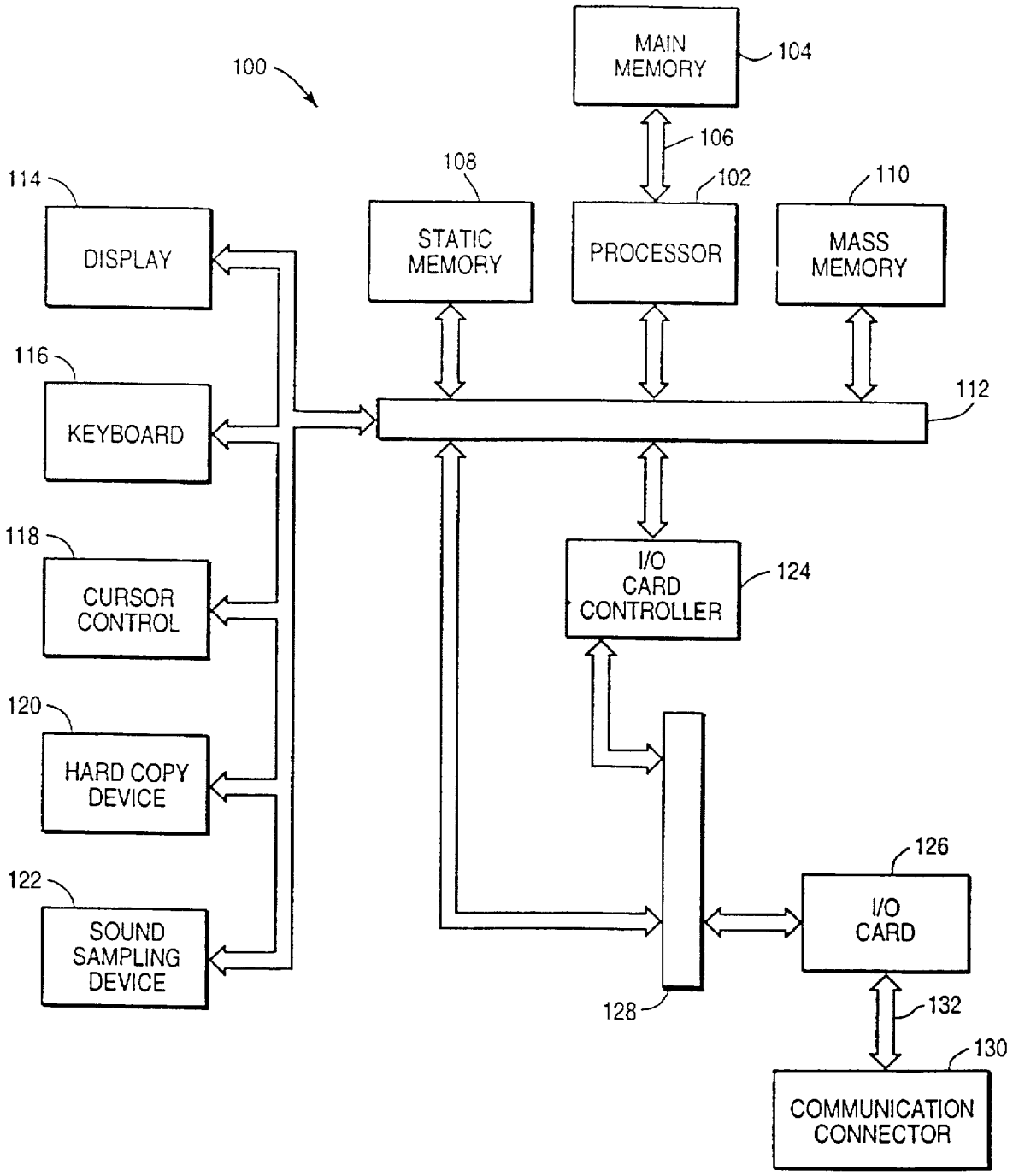
FIG. 1 illustrates, in block diagram form, a data processing system having an input/output card.

FIG. 1 illustrates, in block diagram form, a data processing system 100. Data processing system 100 may be a notebook or laptop computer system. For other embodiments, data processing system may be a desktop or any other suitable type of computer system.

Data processing system 100 includes a processor 102, a main memory 104, a main memory bus 106, a static memory 108, a mass memory 110, a system bus 112, a display 114, an alphanumeric input device 116, a cursor control device 118, a hard copy device 120, a sound sampling device 122, an input/output (I/O) card controller 124, an input/output (I/O) card 126, and an input/output (I/O) card bus 128. Main memory bus 106 couples processor 102 and main memory 104. System bus 112 couples processor 102, static memory 108, mass memory 110, display 114, alphanumeric input device 116, cursor control device 118, hard copy device 120, sound sampling device 122, I/O card controller 124, and I/O card bus 128. I/O card bus 128 couples system bus 112, I/O card controller 124, and I/O card 126.

Processor 102 may include a microprocessor or any other suitable processing device, for example. Processor 102 may execute instructions stored in static memory 108, main memory 104, and/or mass memory 110 for example. Processor 102 may process data stored in static memory 108, main memory 104, and/or mass memory 110 for example. Processor 102 may include a single processing device or a plurality of processing devices.

Static memory 108 may include read only memory (ROM) or any other suitable memory device. Static memory 108 may store, for example, a boot program for execution by processor 102 to initialize data processing system 100. Main memory 104 may include random access memory (RAM) or any other suitable memory device. Mass memory 110 may include a hard disk device, a floppy disk, an optical disk device, a flash memory device, a file server device, or any other suitable memory device. For this detailed description, the term memory includes a single memory device and any combination of suitable memory devices for the storage of data and instructions, for example.

System bus 112 provides for the communication of digital information between hardware devices for data processing system 100. Processor 102 may receive over system bus 112 information that is input by a user through alphanumeric input device 116, cursor control device 118, and/or sound sampling device 122. Alphanumeric input device 116 may include a keyboard, for example, that includes alphanumeric keys. Alphanumeric input device 116 may include other suitable keys, including function keys for example. Alphanumeric input device 116 may be used to input information or commands, for example, for data processing system 100. Cursor control device 118 may include a mouse, touch tablet, track-ball, and/or joystick, for example, for controlling the movement of a cursor displayed by display 114. Sound sampling device 122 may include a microphone, for example, for providing audio recording, information, or commands, for example, for data processing system 100.

Processor 102 may also output over system bus 112 information that is to be displayed on display 114 or outputted by hard copy device 120 or by sound sampling device 122. Display 114 may include a cathode ray tube (CRT) or a liquid crystal display (LCD), for example, for displaying information to a user. Hard copy device 120 may include a printer or a plotter, for example, for creating hard copies of information for data processing system 100. Sound sampling device 122 may include a speaker, for example, for providing audio information, commands, responses or audio playback, for example, for data processing system 100. Processor 102 may use system bus 112 to transmit information to and to receive information from other hardware devices, including mass memory 110 for example.

Processor 102 may also receive from and output information to I/O card 126 using I/O card bus 128. I/O card bus 128 provides for the communication of information between I/O card 126 and other devices for data processing system 100. I/O card controller 124 transmits control and address information, for example, over I/O card bus 128 for controlling I/O card 126.

I/O card 126 provides for a detachable communication interface for data processing system 100. I/O card 126 may receive information over a communication bus 132 from any suitable external communication source. I/O card 126 may also transmit information over communication bus 132 to any suitable external communication destination. I/O card 126 may serve as a modem card, a facsimile card, a fax/modem card, a local area network (LAN) interface card, a multi-media interface card, or a sound card, for example, for data processing system 100. I/O card 126 may serve to provide for other communication capabilities including wireless conmmunication capabilities, for example, for data processing system 100.

I/O card 126 communicates with external communication devices using a communication connector 130. Communication connector 130 provides for a detachable connection for I/O card 126 in communicating with external communication devices. For one embodiment, communication connector 130 includes an RJ-11 connector, for example, for connection to a telephone network. Communication connector 130 may also include an RJ-45 connector, for example, for connection to a local area network. Communication connector 130 may include other suitable types of communication connectors for communication with external devices.

For one embodiment, I/O card 126 is a PCMCIA card. I/O card controller 124 and I/O card bus 128 may be configured in accordance with PCMCIA standards for communicating with a PCMCIA card. For other embodiments, I/O card 126 may be configured according to other suitable card formats.

Data processing system 100 may include other suitable hardware devices or other suitable combinations of hardware devices. Data processing system 100 may include, for example, one or more other suitable I/O cards coupled to I/O card bus 128. Data processing system 100 may be configured without various hardware devices, for example, that are not required for the desired purpose of data processing system 100. Data processing system 100 may be configured without sound sampling device 122 and/or hard copy device 120, for example. Data processing system 100 may also be configured in a variety of manners for any combination of hardware devices. As one example, main memory 104 may be coupled to system bus 112 rather than being coupled to processor 102 by main memory bus 106 as illustrated in FIG. 1.

Figure 2:
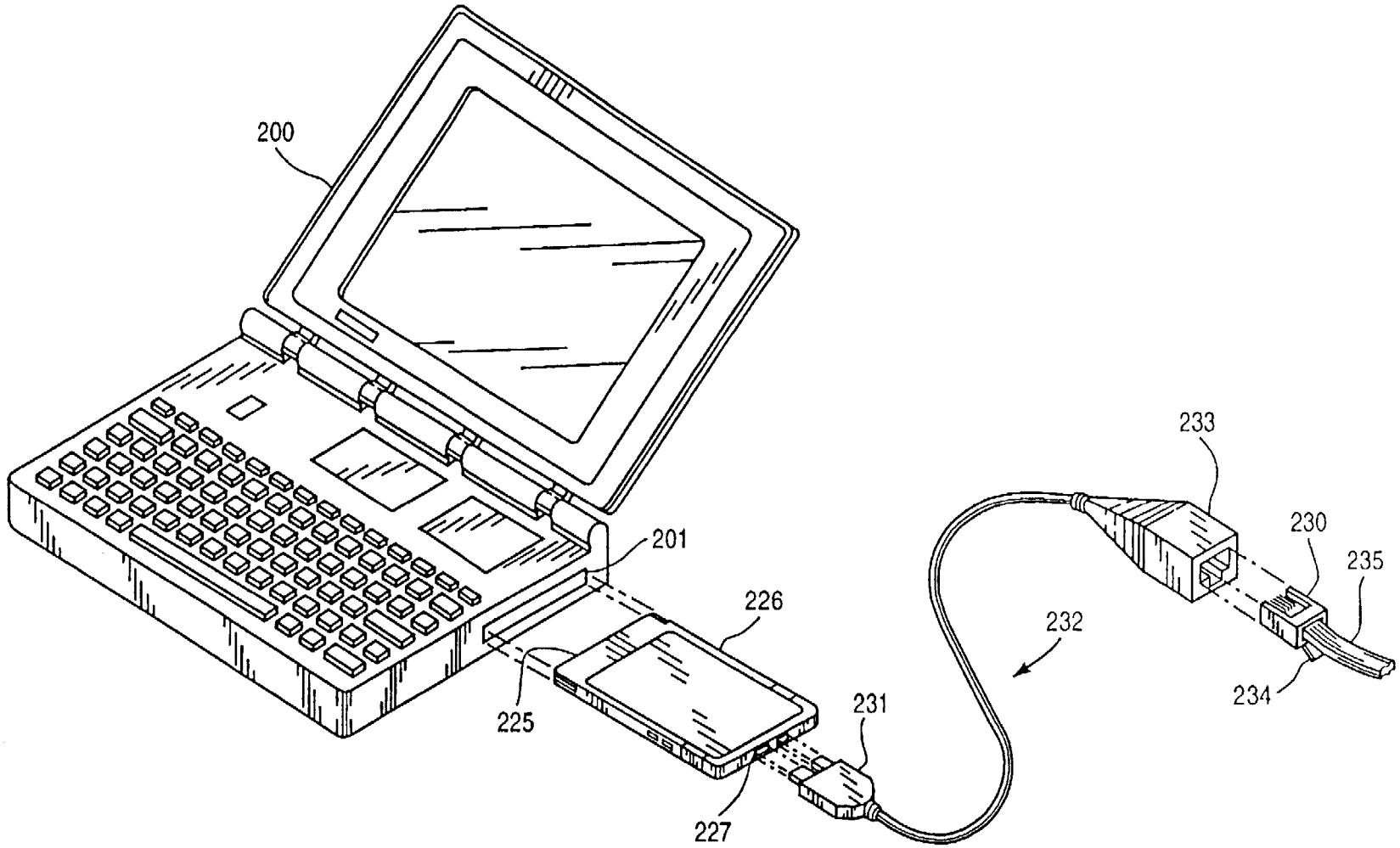
FIG 2 (PRIOR ART)
FIG. 2 illustrates a perspective view of a prior art modem configuration for a data processing system having an input/output card coupled to an adapter cable for connection to an RJ-11 connector.

FIG. 2 illustrates a perspective view of a prior art modem configuration for a data processing system 200. Data processing system 200 is a notebook or laptop computer system. Data processing system 200 has a receptacle 201 for receiving a PCMCIA modem card 226 that may be connected at one end 225 to a socket internal to data processing system 200 for communication with a PCMCIA bus. In accordance with PCMCIA standards, PCMCIA modem card 226 has a 68-pin connector at end 225. PCMCIA modem card 226 is configured with a 14-pin connector at an end 227 opposite end 225.

As illustrated in FIG. 2, end 227 of PCMCIA modem card 226 may be coupled to an adapter cable 232 for connection to an RJ-11 plug 230. Adapter cable 232 includes a connector 231 at one end of a cable and another connector 233 at the other end of the cable. Connector 231 is configured to mate with the 14-pin connector at end 227 of PCMCIA modem card 226. Connector 233 is configured to mate with RJ-11 plug 230. Adapter cable 232 serves as an adapter between RJ-11 plug 230 and the 14-pin connector at end 227 for PCMCIA modem card 226. RJ-11 plug 230 is connected to a line 235 for communication over a telephone network.

Adapter cable 232 is inconvenient to users of data processing system 200 because adapter cable 232 must be carried separately with data processing system 200 and may be forgotten. In transporting data processing system 200, adapter cable 232 is also relatively bulky as compared to PCMCIA modem card 226, for example, that may be easily carried in a pocket or while inserted in data processing system 200.

Figure 3:
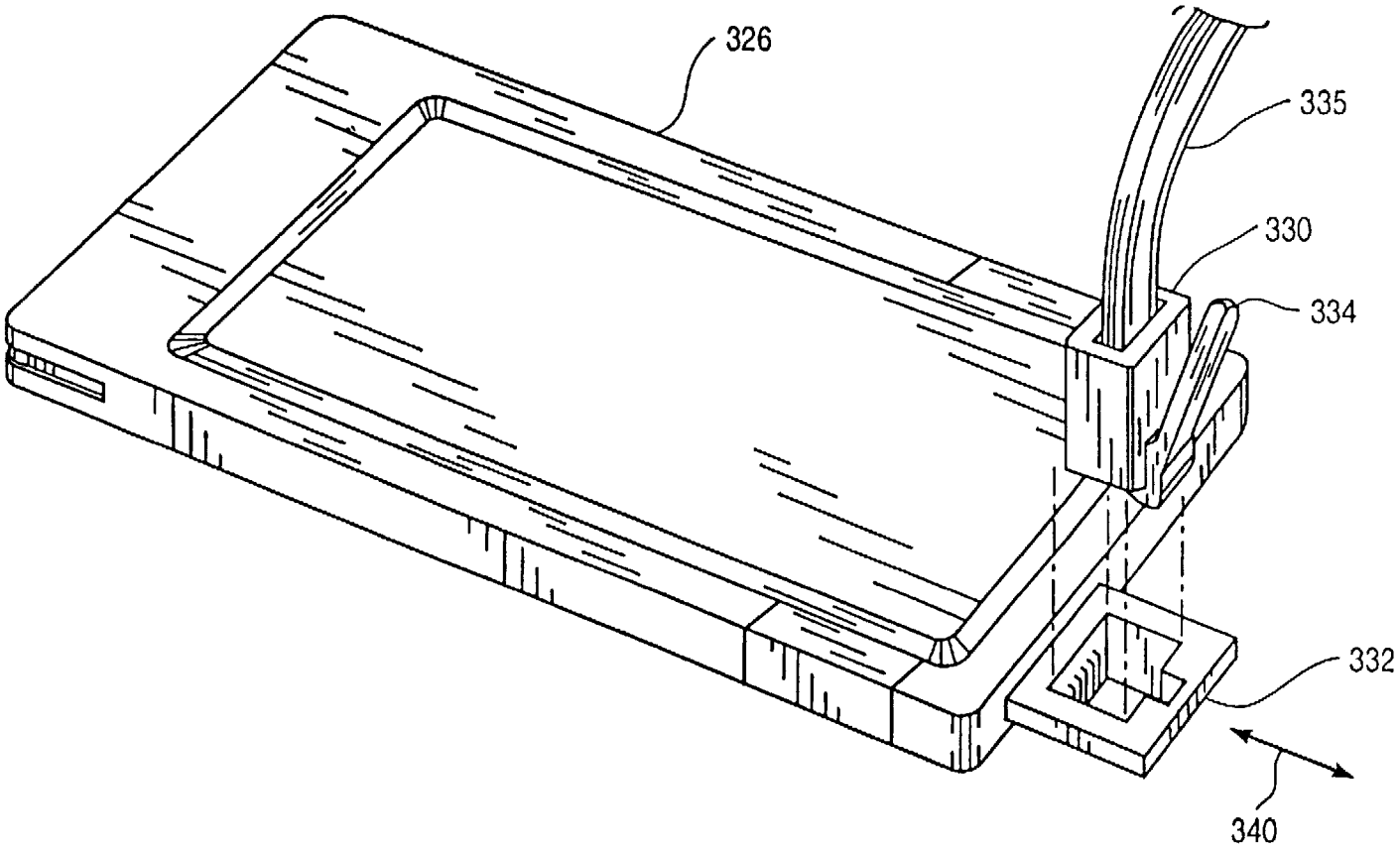
FIG. 3 illustrates a perspective view of another prior art modem configuration where an input/output card has a retractable connector for connection to an RJ-11 connector.

FIG. 3 illustrates a perspective view of another prior art modem configuration for a data processing system. As illustrated in FIG. 3, a PCMCIA modem card 326 has a retractable connector 332 configured to mate with an RJ-11 plug 330. Retractable connector 332 may be retracted into and out from PCMCIA modem card 326 as illustrated by arrow 340 of FIG. 3.

PCMCIA modem card 326 may be inserted into receptacle 201 of data processing system 200, for example, for providing a modem communication capability for data processing system 200. When PCMCIA modem card 326 is inserted in data processing system 200, retractable connector 332 may be engaged to extend from the body of PCMCIA modem card 326 and hence from the body of data processing system 200. RJ-11 plug 330 may then be inserted vertically into the extended connector 332. RJ-11 plug 330 is connected to a line 335 for communication over a telephone network. When not in use, retractable connector 332 may be retracted inside PCMCIA modem card 326.

Because retractable connector 332 is configured to mate with RJ-11 plug 330 using a flexible locking mechanism 334 of RJ-11 plug 330, retractable connector 332 remains connected to RJ-11 plug 330 until RJ-11 plug 330 is manually detached from retractable connector 332. When retractable connector 332 is subjected to a firm tug on line 335, such as when a user trips over line 335 for example, RJ-11 plug 330 as well as retractable connector 332 are susceptible to breakage. Data processing system 200 may also be pulled off a table onto the floor as a result of such a firm tug and consequently damaged. Retractable connector 332 also requires a user-movable retraction mechanism, increasing the complexity of design and manufacture of PCMCIA modem card 326. Furthermore, retractable connector 332 consumes space inside PCMCIA modem card 326 and thus limits the amount of space available for circuitry in implementing the modem function for PCMCIA modem card 326.

Figure 4:
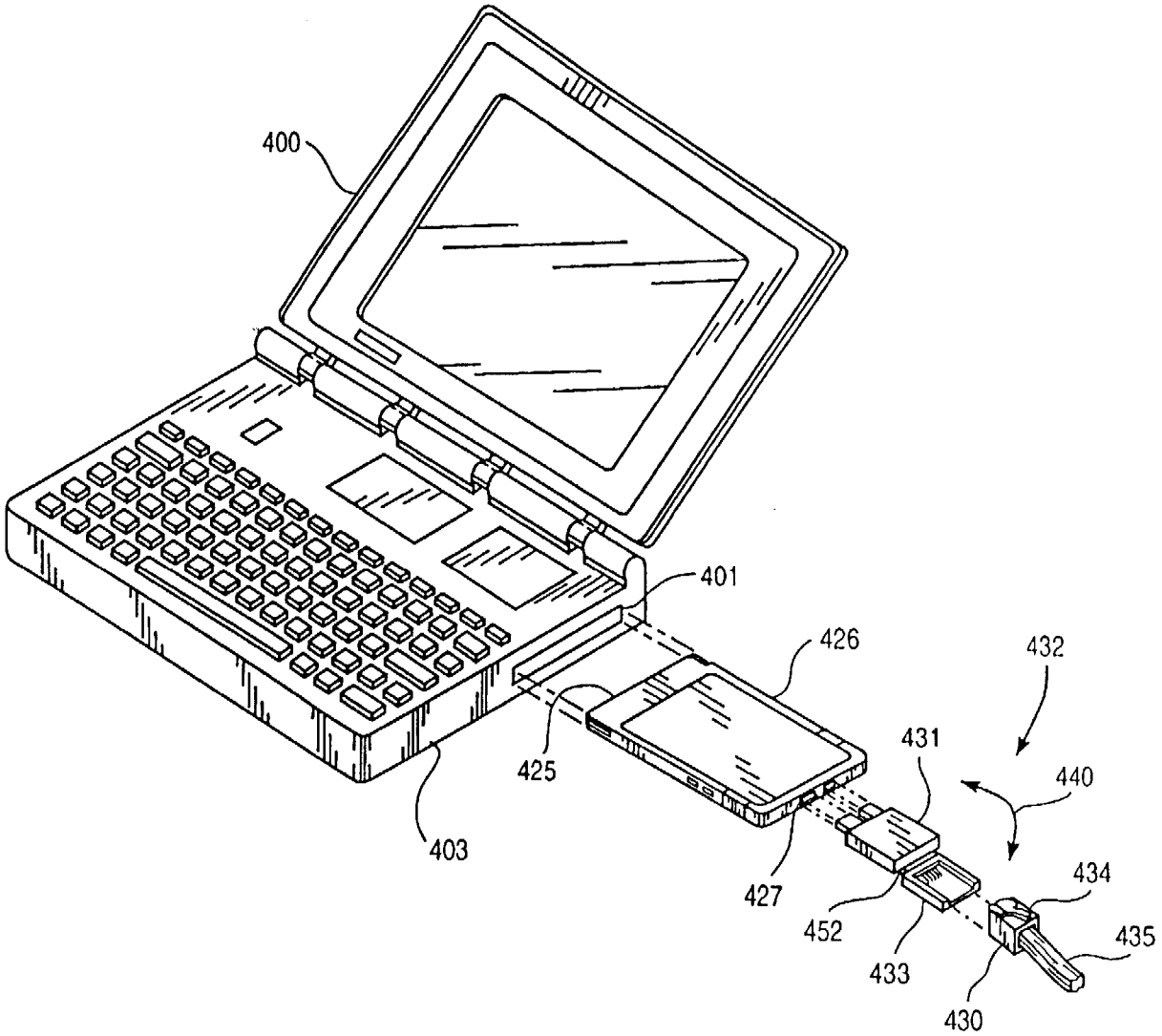
FIG. 4 illustrates, for one embodiment, a perspective view of a data processing system having an input/output card coupled to a hinged adapter for connection to an RJ-11 connector.

FIG. 4 illustrates, for one embodiment, a perspective view of a hinged adapter 432 for use in connecting an input/output (I/O) card 426 to a communication connector 430 for a data processing system 400. Hinged adapter 432 is also referred to as a hi-jack 432.

Data processing system 400 may be configured as data processing system 100 of FIG. 1. The above discussion regarding data processing system 100 and I/O card 126 likewise applies to data processing system 400 and I/O card 426. Although illustrated in FIG. 4 as a notebook or laptop computer system, data processing system 400 may be a desktop or any other suitable type of data processing system. Data processing system 400 is configured to receive I/O card 426 in a receptacle 401 defined by a body 403 of data processing system 400. Receptacle 401 may have any suitable dimensions that may depend, for example, on the dimensions of I/O card 426.

Upon insertion into receptacle 401, I/O card 426 may be connected for communication with data processing system 400 by plugging one end 425 of I/O card 426 into a suitable socket internal to body 403 of data processing system 400. I/O card 426 may then communicate with data processing system 400 over an I/O card bus coupled to the socket.

I/O card 426 is a PCMCIA card for connection to a telephone network, as illustrated in FIG. 4. I/O card 426 may be a modem card, a facsimile card, or a fax/modem card, for example. In accordance with PCMCIA standards, I/O card 426 has a 68-pin connector at end 425. I/O card 426 may be configured with any suitable connector, such as a 14-pin connector for example, at an end 427 opposite end 425. Although illustrated as a PCMCIA card for communication over a telephone network, I/O card 426 may be configured in accordance with other suitable card formats and may serve to provide any suitable communication function for data processing system 400.

As illustrated in FIG. 4, end 427 of I/O card 426 may be coupled to hinged adapter 432 for connection to an RJ-11 plug 430. End 427 of I/O card 426 is exposed by receptacle 401 when I/O card 426 is inserted in receptacle 401 of data processing system 400. Hinged adapter 432 serves as an adapter between RJ-11 plug 430 and the connector at end 427 for I/O card 426. RJ-11 plug 430 is connected to a line 435 for communication over a telephone network.

Hinged adapter 432 includes a first member or connector 431 and a second member or connector 433. First connector 431 is configured to mate with the connector at end 427 of I/O card 426. The configuration of first connector 431 thus depends on the type of connector used at end 427 for I/O card 426. Second connector 433 is configured to mate with RJ-11 plug 430. Second connector 433 may be configured to mate with other suitable connectors, such as an RJ-45 connector for example.

Second connector 433 is mounted on first connector 431 with a hinge 452 such that second connector 433 may be rotated or folded about hinge 452 relative to first connector 431 as illustrated by arrow 440. As illustrated in FIG. 4, second connector 433 is folded downward and extends outward from first connector 431 in an operational position for connection to RJ-11 plug 430. In the operational position, second connector 433 may be aligned, for example, with a substantially horizontal plane relative to data processing system 400. When hinged adapter 432 is connected to I/O card 426 while inserted in receptacle 401 of data processing system 400, second connector 433 preferably extends from body 403 in the operational position such that RJ-11 plug 430 may be connected to second connector 433 with minimized obstruction by body 403. When not in use, second connector 433 may be folded upward about hinge 452 relative to first connector 431 into a stored position.

Figure 5:
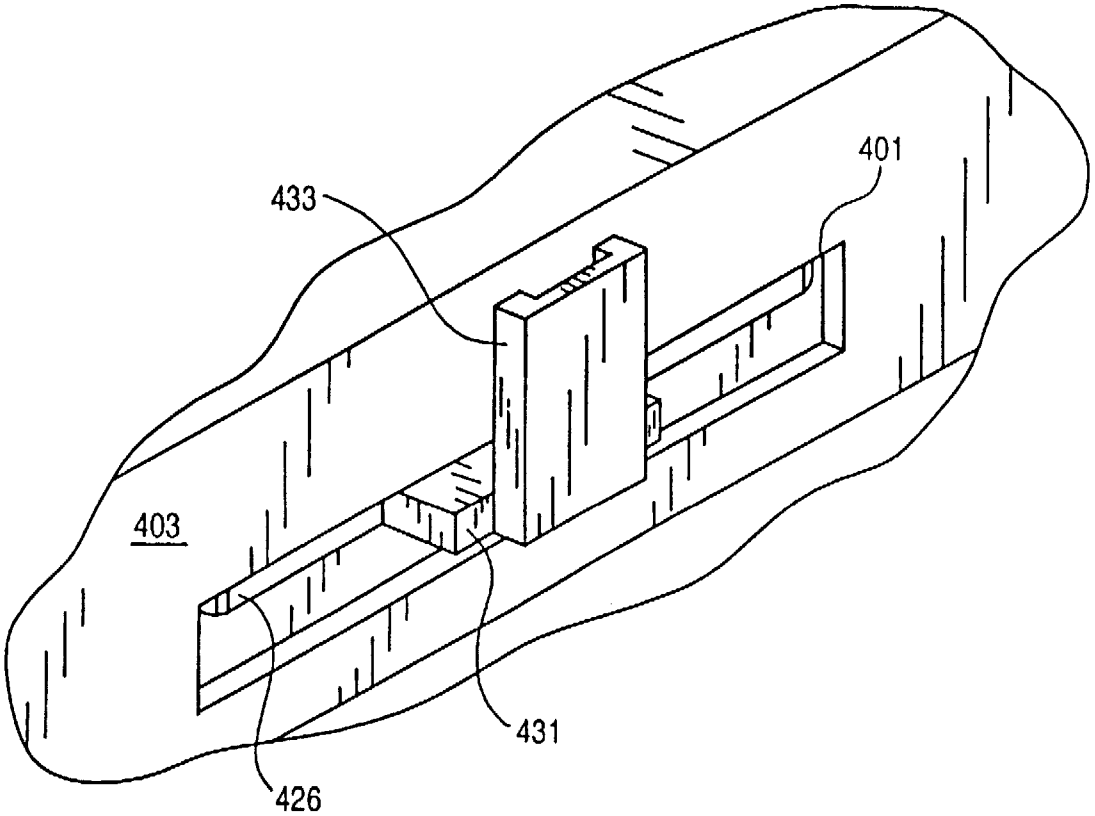
FIG. 5 illustrates, for one embodiment, a perspective view of a data processing system having a hinged adapter in a stored position.

FIG. 5 illustrates, for one embodiment, a perspective view of data processing system 400 having hinged adapter 432 in a stored position. As illustrated in FIG. 5, I/O card 426 is inserted in receptacle 401 of body 403. Hinged adapter 432 is connected to end 427 of I/O card 426 by first connector 431 while second connector 433 is folded upward about hinge 452 relative to first connector 431. Second connector 433 extends upward from and is generally perpendicular to first connector 431 for this stored position. In the stored position, second connector 433 may be aligned, for example, with a substantially vertical plane relative to data processing system 400.

First connector 431 is preferably configured to mate with I/O card 426 within receptacle 401 such that second connector 433 is generally flush with the side of body 403 as illustrated in FIG. 5. That is, first connector 431 preferably does not extend from body 403 so as to create a relatively large gap between body 403 and second connector 433 while second connector 433 is folded upward in the stored position.

With second connector 433 placed in the stored position, data processing system 400 may be conveniently transported while I/O card 426 is inserted in receptacle 401 and while hinged adapter 432 remains connected to I/O card 426. As compared to adapter cable 232 of FIG. 2, hinged adapter 432 is relatively less bulky and may be integrated with data processing system 400 as illustrated in FIG. 5 to provide for relatively convenient transportation of data processing system 400, I/O card 426, and hinged adapter 432 as an integral unit.

Furthermore, hinged adapter 432 does not consume space inside I/O card 426, unlike retractable connector 332 of FIG. 3, and thus does not limit the amount of space available for circuitry in implementing the functionality provided by I/O card 426. As hinged adapter 432 is physically separate from I/O card 426, hinged adapter 432 also does not require the manufacture of new I/O cards, as use of retractable connector 332 does, and thus may be used for connection with pre-existing I/O cards.

Figure 6:
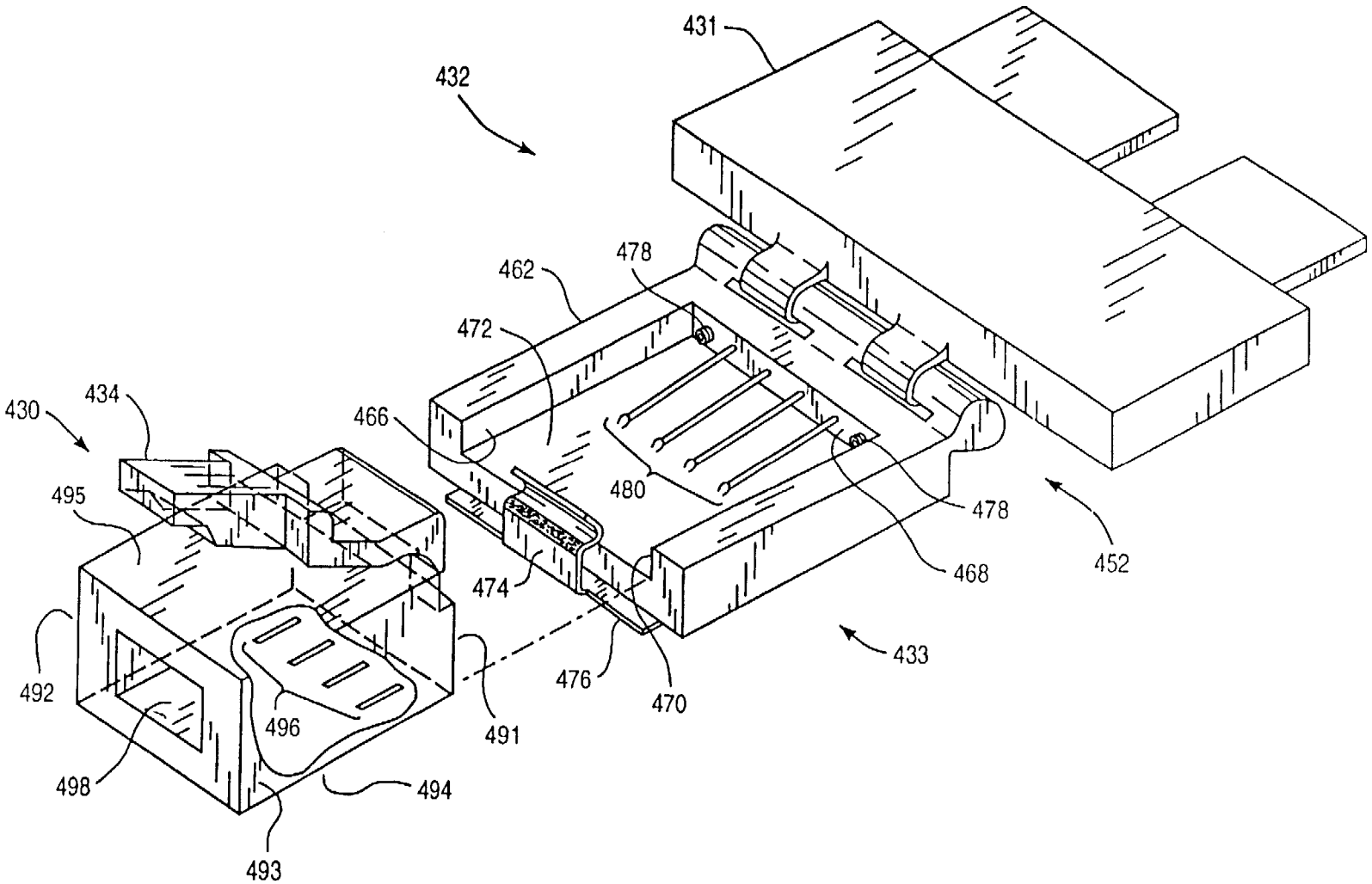
FIG. 6 illustrates a perspective view of a hinged adapter for one embodiment.

FIG. 6 illustrates a perspective view of hinged adapter 432 for one embodiment. First connector 431 of FIG. 6 is illustrated as being configured to mate with a 14-pin connector at end 427 of I/O card 426. First connector 431 may be configured to mate with other suitable I/O card connectors and may be manufactured using any suitable materials, including plastics for example, to house electrical conductors for connection to the connector at end 427 of I/O card 426.

As illustrated in FIG. 6, second connector 433 may be a tray-type socket configured to mate with RJ-11 plug 430. Second connector 433 includes a tray 462 formed by three side members 466, 468, and 470, and a bottom plate 472 having a substantially planar surface. A mechanically deformable clip 474 forms a fourth side for tray 462. Clip 474 may be stamped from any number of well known springy metals in a single piece consisting of a flange 476 and clip 474. Flange 476 is attached to the underside of bottom plate 472. Two points 478 are mounted to side member 468 and extend outwardly therefrom. Points 478 are made of a hard material such as a metal or hard plastic. Electrical contacts 480 are positioned in tray 462 for electrical connection with RJ-11 plug 430. Electrical contacts 480 are connected to suitable conductors housed within first connector 431 for electrical connection to I/O card 426. Suitable wiring may be routed from electrical contacts 480, for example through side member 468 or bottom plate 472 and around or through hinge 452, to provide for this electrical connection. RJ-11 plug 430 includes a housing with a front face 491, side faces 492 and 493, a bottom face 494 and a top face 495. RJ-11 plug 430 includes electrical contacts 496 for mating with electrical contacts 480 in tray 462. The housing defines a cavity 498 at a rear face of RJ-11 plug 430 to allow access to electrical contacts 496. A multi-conductor line is inserted into RJ-11 plug 430 through cavity 498 and connected for electrical contact with electrical contacts 496. RJ-11 plug 430 further includes a flexible locking mechanism 434.

RJ-11 plug 430 may be inserted into tray 462 by positioning front face 491 against side member 468 and pushing RJ-11 plug 430 downward toward bottom plate 472. As this is done, points 478 burrow into the relatively soft plastic of front face 491 of RJ-11 plug 430, holding the front end of RJ-11 plug 430 in place. RJ-11 plug 430 may also be configured with two small recesses to mate with points 478. Mechanically deformable clip 474 deforms outwardly from its base position, which is vertical to the sides of tray 462, until bottom face 494 of RJ-11 plug 430 rests on bottom plate 472 of tray 462. Clip 474 returns to its base position and fits into cavity 498, holding the rear end of RJ-11 plug 430 in place. Electrical contacts 480 and electrical contacts 496 make electrical contact.

Locking mechanism 434 is not used for holding RJ-11 plug 430 in tray 462. When RJ-11 plug 430 is subjected to a firm tug of sufficient force, such as when a user trips over the line connected to RJ-11 plug 430 through cavity 498, RJ-11 plug 430 is released from tray 462. Clip 474 deforms outwardly from its base position as a result of this firm tug and allows RJ-11 plug 430 to come away from tray 462. As compared to retractable connector 332 of FIG. 3, RJ-11 plug 430 and the connector at end 427 of I/O card 426 are less susceptible to breakage from such a firm tug. Data processing system 400 is also less susceptible to damage from being pulled off a table onto the floor as a result of such a firm tug.

Second connector 433 may be configured to mate with RJ-11 plug 430 in other manners. For other embodiments, second connector 433 may be configured to mate with RJ-11 plug 430 as described in U.S. patent application Ser. No. 08/275,599, entitled I/O CONNECTOR FOR ADD IN PRINTED CIRCUIT CARDS FOR COMPUTER SYSTEMS, by Duncan D. MacGregor, Neal E. Broadbent, Chengwu Chen, and Richard Gargiulo, filed Jul. 15, 1994, and assigned to the assignee of the present patent application. Second connector 433 may also be configured to mate with other suitable connectors, such as an RJ-45 connector for example.

Hinge 452 may be configured in any suitable manner to allow second connector 433 to rotate or fold about hinge 452 relative to first connector 431 between the operational position and the stored position. For one embodiment, the bodies for first connector 431 and for second connector 433 may be physically molded or configured such that second connector 433 may be mounted to first connector 431 to form hinge 452. For other embodiments, a separate hinge 452 may be configured with first connector 431 and second connector 433.

Hinged adapter 432 may also be configured to hold or latch second connector 433 in the operational position and/or in the stored position. Hinged adapter 432 may be configured in any suitable manner to prevent or deter second connector 433 from rotating about hinge 452 relative to first connector 431 when in a desired position. As one example, hinged adapter 432 may be configured with a suitable detent to prevent second connector 433 from rotating about hinge 452 when in the stored position.

For other embodiments, hinged adapter 432 may be configured to allow second connector 433 to be rotated or folded from the operational position downward relative to first connector 431 to a stored position. Second connector 433 extends downward from and is generally perpendicular to first connector 431 for this stored position. Hinged adapter 432 may further be configured to allow second connector 433 to be rotated or folded in a generally left-and-right manner relative to first connector 431 as opposed to a generally up-and-down manner. As one example, second connector 433 of FIG. 6 may be mounted sideways relative to first connector 431 such that second connector 433 folds to the left or right of first connector 431 in a stored position generally flush with the side of body 403 for data processing system 400.

Although described as having hinge 452, adapter 432 may also be configured in other suitable manners to allow second connector 433 to be positioned in an operational position and in a stored position. Adapter 432 may be configured with a suitable ball-and-socket joint, for example, to allow second connector 433 to rotate about the ball-and-socket joint relative to first connector 431.

In the foregoing description, the invention has been described with reference to specific exemplary embodiments thereof. It will, however, be evident that various modifications and changes may be made thereto without departing from the broader spirit or scope of the present invention as defined in the appended claims. The specification and drawings are, accordingly, to be regarded in an illustrative rather than a restrictive sense.

What is claimed is:

1. A communications adapter for connecting a communication connector and an input/output (I/O) card inserted in a receptacle defined by a body of a data processing system, the I/O card having an I/O card connector at an end exposed by the receptacle when the I/O card is inserted in the receptacle of the body of the data processing system, the communications adapter comprising:

a first member configured to mate with the I/O card connector of the I/O card;

a second member configured to mate with the communication connector;

the second member configured with the first member such that the second member may be positioned in an operational position for mating with the communication connector when the first member is mated with the I/O card connector of the I/O card in the receptacle of the body of the data processing system; and the second member configured with the first member such that the second member may be positioned in a stored position different from the operational position when the first member is mated with the I/O card connector of the I/O card in the receptacle of the body of the data processing system.

2. The communications adapter of claim 1, wherein the I/O card connector is a 14-pin connector.

3. The communications adapter of claim 1, wherein the communication connector is an RJ-11 plug or an RJ-45 plug.

4. The communications adapter of claim 1, wherein the I/O card is a PCMCIA card.

5. The communications adapter of claim 1, wherein the second member includes a tray configured for mating with the communication connector.

6. The communications adapter of claim 1, wherein the second member is rotatably configured with the first member such that the second member may be positioned by rotating the second member relative to the first member.

7. The communications adapter of claim 6, wherein the second member is mounted to the first member with a hinge.

8. An input/output (I/O) card combination for connecting a data processing system and a communication connector, the data processing system having a body defining a receptacle, the I/O card combination comprising:

an I/O card for insertion into the receptacle of the body of the data processing system, the I/O card configured for connection to the data processing system and having an I/O card connector at an end exposed by the receptacle when the I/O card is inserted in the receptacle of the body of the data processing system;

a first member configured to mate with the I/O card connector of the I/O card;

a second member configured to mate with the communication connector;

the second member configured with the first member such that the second member may be positioned in an operational position for mating with the communication connector when the first member is mated with the I/O card connector of the I/O card in the receptacle of the body of the data processing system; and the second member configured with the first member such that the second member may be positioned in a stored position different from the operational position when the first member is mated with the I/O card connector of the I/O card in the receptacle of the body of the data processing system.

9. The I/O card combination of claim 8, wherein the I/O card connector is a 14-pin connector.

10. The I/O card combination of claim 8, wherein the communication connector is an RJ-11 plug or an RJ-45 plug.

11. The I/O card combination of claim 8, wherein the I/O card is a PCMCIA card.

12. The I/O card combination of claim 8, wherein the second member includes a tray configured for mating with the communication connector.

13. The I/O card combination of claim 8, wherein the second member is rotatably configured with the first member such that the second member may be positioned by rotating the second member relative to the first member.

14. The I/O card combination of claim 13, wherein the second member is mounted to the first member with a hinge.

15. A communications adapter for connecting a communication connector and an input/output (I/O) card inserted in a receptacle defined by a body of a data processing system, the I/O card having an I/O card connector at an end exposed by the receptacle when the I/O card is inserted in the receptacle of the body of the data processing system, the communications adapter comprising:

first means for mating with the I/O card connector of the I/O card;

second means for mating with the communication connector;

positioning means for allowing the second means to be positioned in an operational position for mating with the communication connector when the first means is mated with the I/O card connector of the I/O card in the receptacle of the body of the data processing system; and the positioning means for allowing the second means to be positioned in a stored position different from the operational position when the first means is mated with the I/O card connector of the I/O card in the receptacle of the body of the data processing system.

16. The communications adapter of claim 15, wherein the I/O card connector is a 14-pin connector.

17. The communications adapter of claim 15, wherein the communication connector is an RJ-11 plug or an RJ-45 plug.

18. The communications adapter of claim 15, wherein the I/O card is a PCMCIA card.

19. The communications adapter of claim 15, wherein the second means includes a tray configured for mating with the communication connector.

20. The communications adapter of claim 15, wherein the positioning means includes means for rotating the second means relative to the first means to position the second means.

21. The communications adapter of claim 20, wherein the rotating means includes a hinge.

22. An input/output (I/O) card combination for connecting a data processing system and a communication connector, the data processing system having a body defining a receptacle, the I/O card combination comprising:

an I/O card for insertion into the receptacle of the body of the data processing system, the I/O card configured for connection to the data processing system and having an I/O card connector at an end exposed by the receptacle when the I/O card is inserted in the receptacle of the body of the data processing system;

first means for mating with the I/O card connector of the I/O card;

second means for mating with the communication connector;

positioning means for allowing the second means to be positioned in an operational position for mating with the communication connector when the first means is mated with the I/O card connector of the I/O card in the receptacle of the body of the data processing system; and the positioning means for allowing the second means to be positioned in a stored position different from the operational position when the first means is mated with the I/O card connector of the I/O card in the receptacle of the body of the data processing system.

23. The I/O card combination of claim 22, wherein the I/O card connector is a 14-pin connector.

24. The I/O card combination of claim 22, wherein the communication connector is an RJ-11 plug or an RJ-45 plug.

25. The I/O card combination of claim 22, wherein the I/O card is a PCMCIA card.

26. The I/O card combination of claim 22, wherein the second means includes a tray configured for mating with the communication connector.

27. The I/O card combination of claim 22, wherein the positioning means includes means for rotating the second means relative to the first means to position the second means.

28. The I/O card combination of claim 27, wherein the rotating means includes a hinge.

* * * * *